US005301462A

United States Patent [19]

Hronyetz

[11] Patent Number: 5,301,462

[45] Date of Patent: Apr. 12, 1994

[54] ADJUSTABLE TREE STAND

[76] Inventor: Albert L. Hronyetz, 70 Chicago Ave., Lower Burrell, Pa. 15068

[21] Appl. No.: 895,270

[22] Filed: Jun. 8, 1992

[51] Int. Cl.[5] ..... A47G 7/02

[52] U.S. Cl. ..... 47/40.5; 248/521

[58] Field of Search ..... 47/40.5; 248/521, 520, 248/538, 181, 288.3, 481

[56] References Cited

U.S. PATENT DOCUMENTS 913,474 2/1909 Dreibass ..... 47/40.5
2,812,916 11/1957 Jonasson ..... 47/40.5
3,298,642 1/1967 Taylor ..... 248/181
3,298,643 1/1967 Taylor ..... 47/40.5
4,571,882 2/1986 Caper ..... 47/40.5
4,913,395 1/1990 Juhas ..... 47/40.5

*Primary Examiner*—Henry E. Raduazo
*Attorney, Agent, or Firm*—James Irwin

[57] ABSTRACT

This invention relates to stands for cut trees, such as Christmas trees, and more particularly, it relates to a tree stand which permits the tree to be mounted vertically even when the tree trunk is bent.

3 Claims, 3 Drawing Sheets

ADJUSTABLE TREE STAND

INTRODUCTION

Numerous stands have been provided for mounting cut trees, such as Christmas trees; however, these stands have not been without problems. For example, if the lower portion of the tree trunk is bent or bowed, often it is very difficult to mount the tree vertically. Or, if the tree is mounted vertically, it is only with a great amount of trial and error.

In the art, U.S. Pat. No. 4,156,323 discloses a tree supporting stand having a central support member mounting a plurality of radially extending legs, each of which is adapted to engage a horizontal surface for supporting a tree.

U.S. Pat. No. 3,231,227 discloses an adjustable tree support to make allowances for curvature in tree trunks and to actually hold tree trunks in a vertical position.

U.S. Pat. No. 3,779,493 discloses a stand for trees, particularly means to secure the tree in a water container to take various positions of inclination. A ball joint is provided to permit adjustment of the alignment of the water container relative to the base supporting the tree.

U.S. Pat. No. 4,699,347 discloses a a Christmas tree stand having a circular base and three legs extending upward in tripod form to an apex where a clamping mechanism is located. A ball is securely held between a claim base located atop one leg and a clamp top. An elongated member pivots on the socket leg, and the tree can be adjusted to the vertical position.

U.S. Pat. No. 4,571,882 discloses a tree stand which permits a tree, if deformed or if placed in the stand at an angle, to be aligned in a perpendicular position with respect to any type of floor, whether it be irregular or uneven. The receptacle for retaining the tree is formed integral therewith a hemispherical ball which is received by two adjustable jaws which form a hemispherical cavity.

The present invention overcomes the problems encountered in prior tree stands and permits mounting and securing the tree in a vertical position with ease.

SUMMARY OF THE INVENTION

Disclosed is an improved tree stand for holding a tree trunk to position a tree in a substantially vertical position. The tree stand is comprised of a base member having a clamp means positioned on the base member, a tree trunk holder having a sleeve for receiving the tree trunk. The sleeve has a circumferential band thereon which has a substantially circular outer surface. A clamp means is attached to the base member and is designed to receive the circumferential band and to permit the tree trunk holder to swivel prior to being clamped in position.

It is, therefore, an object of this invention to provide an improved tree stand.

It is yet another object of this invention to provide an improved tree stand having a tree trunk holder which permits ease of positioning a cut tree in the vertical position even when the tree trunk is bent or crooked.

Yet another object is to provide a tree stand having an adjustable tree trunk holder.

These and other objects of the invention will be understood from the following description and accompanying drawings.

DETAILED DESCRIPTION OF THE PREFERRED EMBODIMENTS

Figure 1:
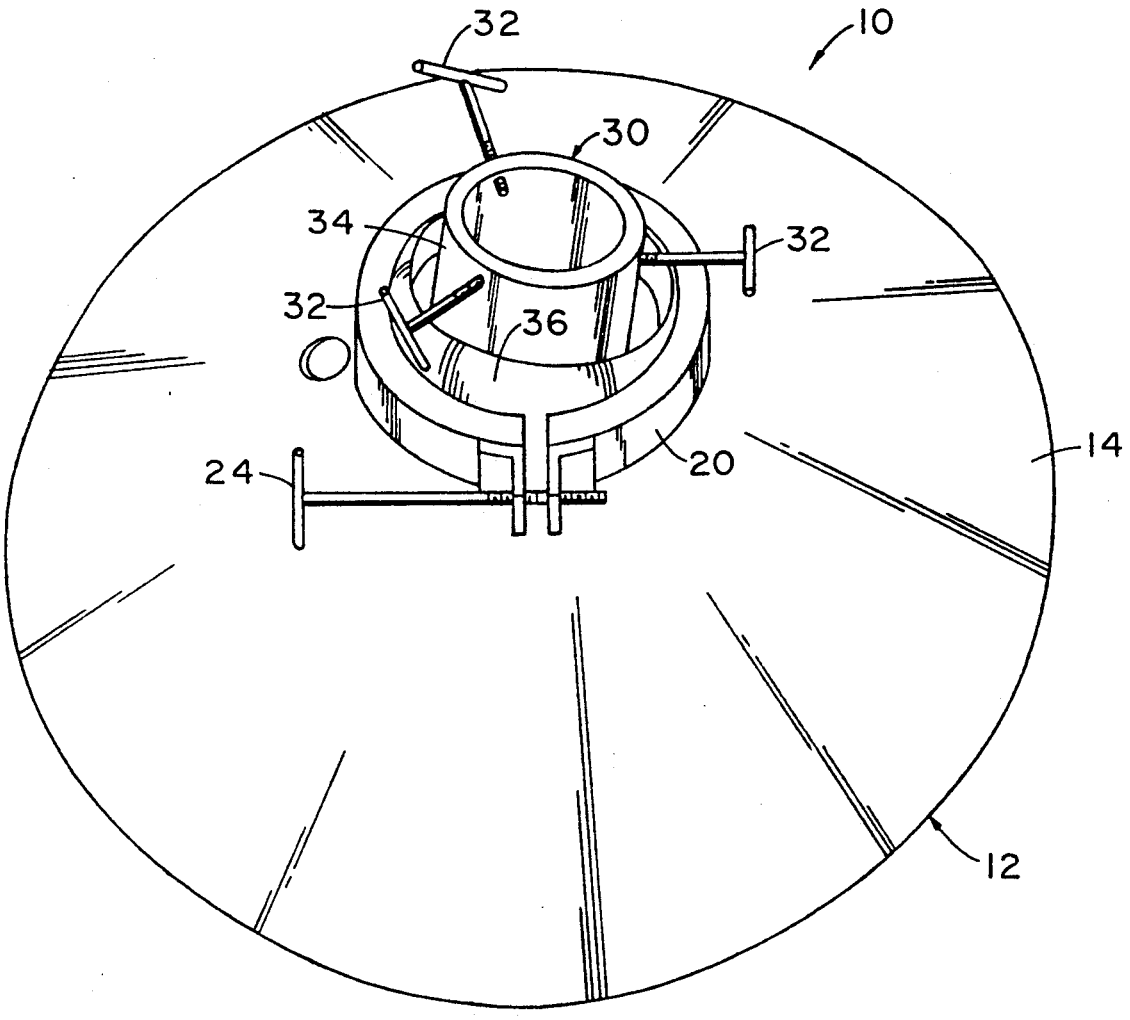
FIG. 1 is a perspective view of the tree stand showing a tree trunk holder and base.
Figure 2:
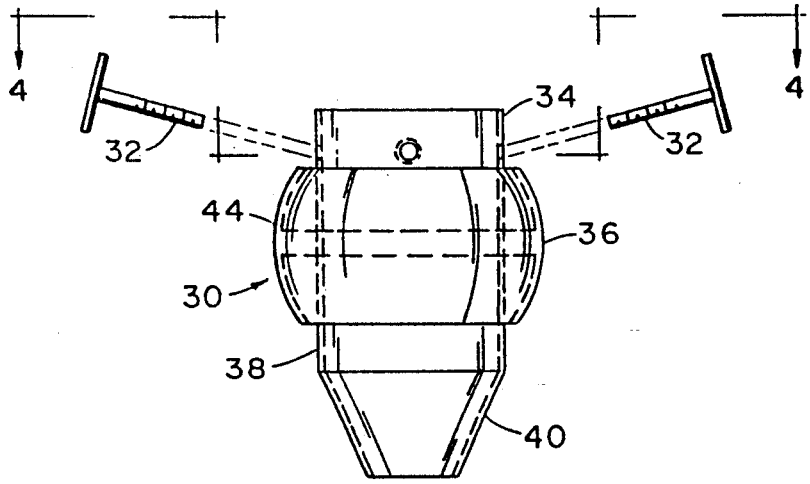
FIG. 2 is an elevational view of the tree trunk holder.
Figure 6:
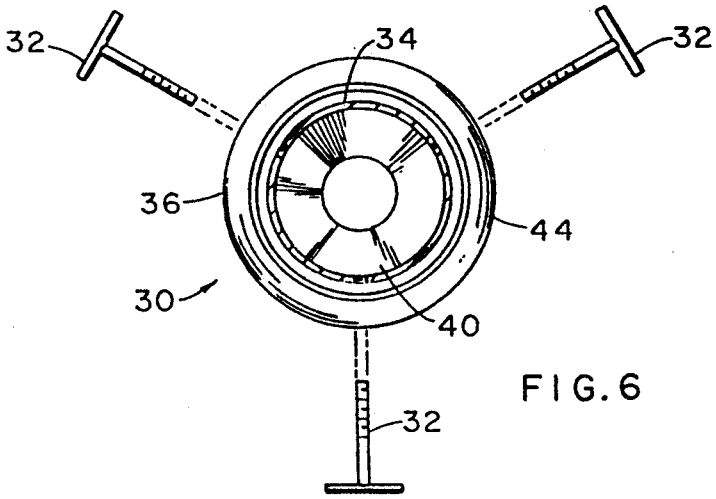
FIG. 6 is a top view of the tree trunk holder along the line 4—4.
Figure 5:
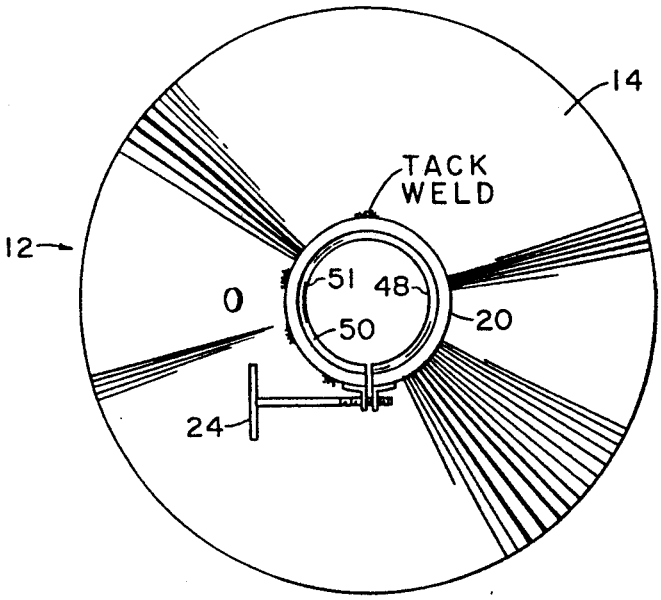
FIG. 5 is a top view of the base along the line 5—5.
Figure 4:
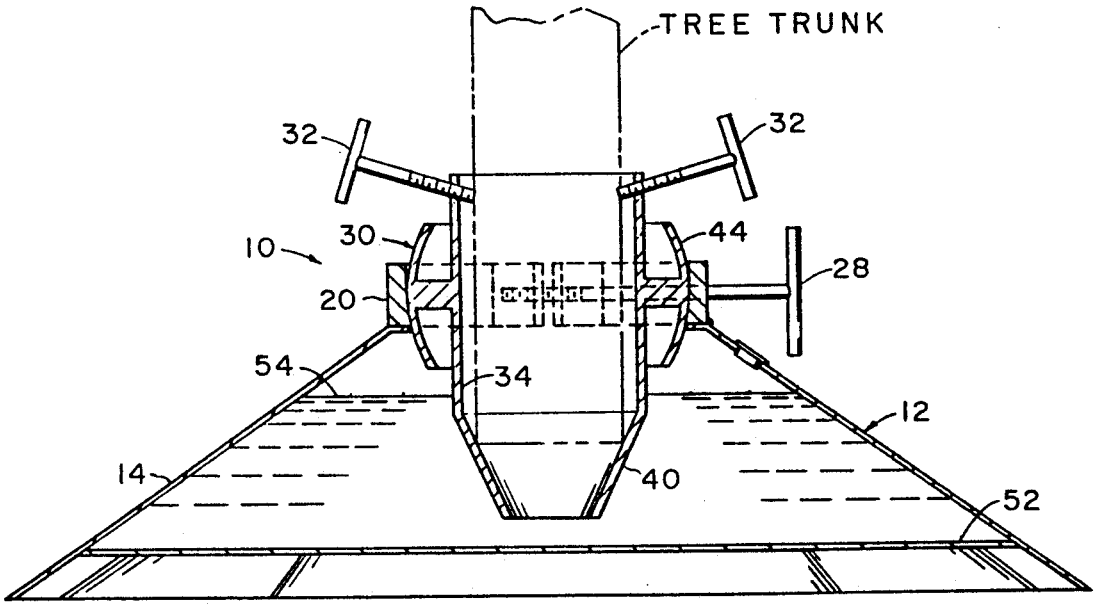
FIG. 4 is a cross-sectional view of the base and tree trunk holder showing water in the base.

FIG. 1 is a perspective view of the tree stand 10 showing a circular base 12 having side wall 14 and collar 20. Collar 20 has a screw mechanism 24 which can be turned to clamp tightly around a tree trunk holder referred to generally as 30. Tree trunk holder 30 (FIGS. 2 and 6) comprises a sleeve-shaped portion 34 and has fasteners 32 for gripping the tree trunk upon its insertion into the sleeve-shaped portion. As can be seen in FIG. 2, sleeve-shaped portion 34 has a circumferential band 36 rigidly attached to sleeve-shaped portion 34. Band 36 is positioned on sleeve-shaped portion 34 to enable a part 38 of sleeve-shaped portion 34 to project into base 12 as seen in FIG. 4. In addition, sleeve-shaped portion 34 preferably has a part thereof which projects above band 36 to enable fastening of the trunk in the sleeve portion. Further, preferably sleeve portion has an end 40 which is tapered sufficiently inwardly to prevent the tree trunk from slipping through the sleeve portion. That is, tapered end 40 serves as a stop and prevents the tree trunk from resting on bottom 42 which would interfere with adjusting the tree into the vertical position, thereby defeating the purpose of the present invention.

Figure 3:
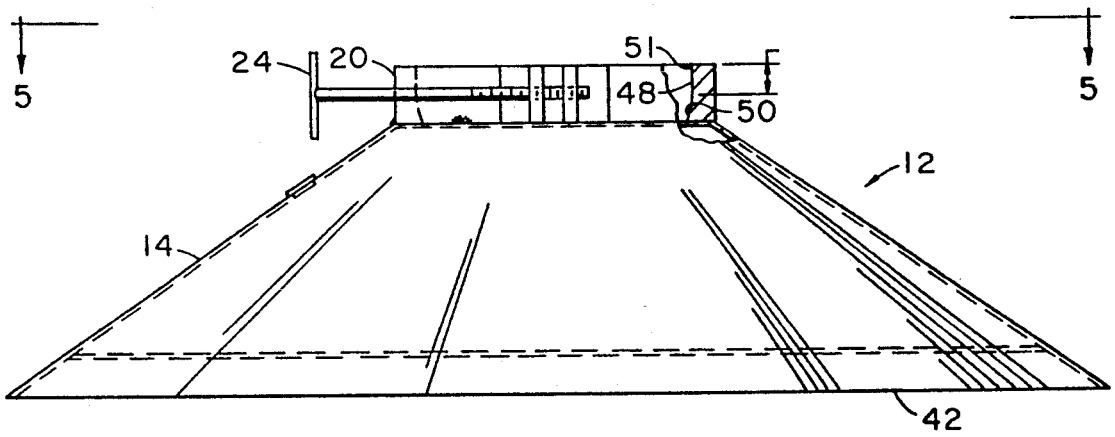
FIG. 3 is an elevational view of the base.

Circumferential band 36 is generally circular and has an outer surface 44 which is curved or arched as shown. Preferably, surface 44 is curved to form a sector of a circle. As shown in FIG. 3, collar 20 has an interior surface 48 which is curved inwardly at lower section 50. That is, the inside diameter of collar 20 at lower extremity 50 is smaller than the inside diameter of collar 20 at upper extremity 51. The dimensions of band 36 should be such to permit the band to fit snugly in collar 20, as shown in FIG. 4. Surface 44 should be rounded or curved as noted to permit sleeve-shaped portion 34 to swivel or tilt from a vertical axis, as shown in FIG. 1, for example. Lower section 50 acts as a stop and as a bearing surface against band surface 44, thereby permitting sleeve-shaped portion 34 to be rotated when the tree trunk is inserted into the sleeve portion.

Collar 20 has a clamp means to secure band 36. The clamp shown is a screw mechanism 24 which serves to tighten collar 20 about circumferential band 36 whenever the tree has been placed in a desirable vertical position. Preferably, collar 20 is securely fastened at one point by welding, for example, so as to permit collar 20 to adjust and clamp band 36 firmly.

In using the adjustable stand, sleeve-shaped portion 34 may be removed from the base and the sleeve portion mounted on the tree trunk. The sleeve portion can be securely fastened to the trunk with screws 32 without the need for precisely centering the tree trunk within the sleeve portion. The sleeve portion containing the trunk is then placed in collar 20 and the tree rotated to a vertical position where it is then clamped using screw mechanism 24.

The adjustable tree stand has the added advantage that base 12 serves as a container for water 54 to keep the tree in fresh condition. An opening for adding water to the base may be provided in wall 14.

Further, the adjustable tree stand, including base and sleeve portion, can be fabricated or formed from plastic material, steel or aluminum, or like materials.

While the invention has been described with respect to embodiments and configurations shown in the drawings, it will be appreciated that other embodiments and configurations may be used which employ the spirit of the invention, and such is contemplated within the purview of the invention.

What is claimed is:

1. An adjustable tree stand for holding a tree trunk to position a tree in a substantially vertical position, the tree stand comprised of:

(a) a base member having a collar-shaped clamp means comprising a cylindrically curved strip of material positioned on said base member and attached thereto; and (b) a tree trunk holder having a sleeve for receiving said tree trunk, the sleeve having a circumferential band thereon, the band having a substantial circular outer surface, said collar-shaped clamp means designed to receive said circumferential band and to permit said tree trunk holder to swivel prior to being clamped in position.

2. The tree stand in accordance with claim 1 wherein the base comprises a bottom and side member, the side member having an upper portion and lower portion, the lower portion joined to said base, the side member extending above said base to form a container, the upper portion joined to said clamp means.

3. An adjustable tree stand for holding a tree trunk to position a tree in substantially vertical position, the tree stand comprised of:

(a) a base having a bottom for positioning on a floor;

(b) a side member having upper and lower portions, the lower portion of the side member joined to the base, the side member extending above said base to form a container;

(c) a clamp means positioned above said base, the upper portion of said side member attached to said clamp means, the clamp means comprising a cylindrical shaped collar having an inside surface having a lower inwardly curved extremity, the collar positioned substantially perpendicular to said base; and (d) a tree trunk holder having a sleeve for receiving said trunk, the sleeve having a circumferential band thereon, the band having a substantially circular outer surface which fits snugly within said collar, the outer surface of said band defining a curved section, the lower inwardly curved extremity of said collar providing a bearing surface for said curved section, thereby permitting said tree trunk holder to swivel and to be clamped within said collar.

* * * * *